United States Patent [19]

Theodore

[11] Patent Number: 4,974,908

[45] Date of Patent: Dec. 4, 1990

[54] METHOD OF FORMING A BRUSH

[75] Inventor: Jack Theodore, San Jose, Calif.

[73] Assignee: Photofinish Cosmetics Inc., Encino, Calif.

[21] Appl. No.: 481,872

[22] Filed: Feb. 20, 1990

[51] Int. Cl.[5] ..... A46D 3/00

[52] U.S. Cl. ..... 300/21

[58] Field of Search ..... 300/21, 2–11; 156/72, 293; 264/243

[56] References Cited

U.S. PATENT DOCUMENTS 4,525,890 7/1985 Peerman et al. ..... 156/72 X 4,795,218 1/1989 Seidler ..... 300/21

*Primary Examiner*—Mark Rosenbaum

*Attorney, Agent, or Firm*—Cohen, Pontani & Lieberman

[57] ABSTRACT

A brush is fabricated by forming a plurality of filaments into a tuft. The proximal ends of the filaments in the tuft are secured together to define a brush head. An elongated, substantially flexible tube having a longitudinally-extending passageway therethrough is inserted into a peripherally-interior portion of the tuft. The filaments which lie immediately adjacent the tube are then secured to the tube periphery along substantially the full length of the tube so as to positionally fix the tube within the filaments tuft and thereby define an integral and substantially flexible fluid distribution channel in the brush for feeding a flowable fluid through the brush from the brush head to the filaments proximate their distal ends for selective application of the fluid to a workpiece.

35 Claims, 2 Drawing Sheets

FIG. 4
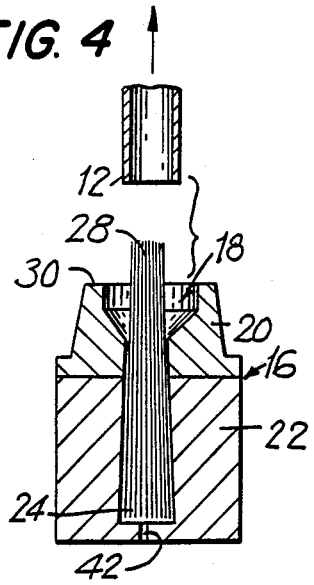
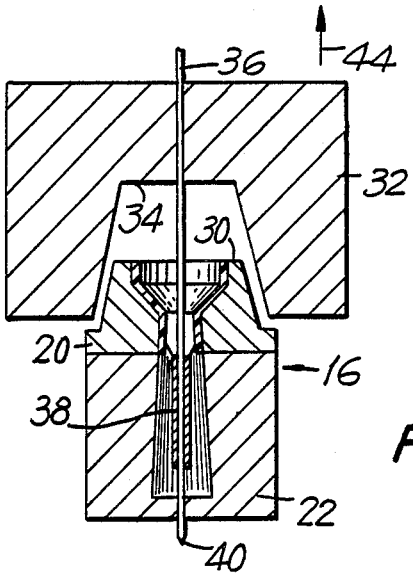
FIG. 7
FIG. 8
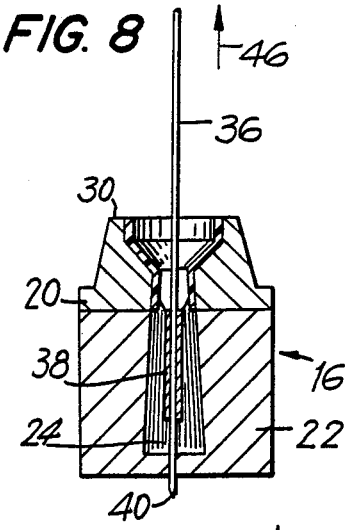
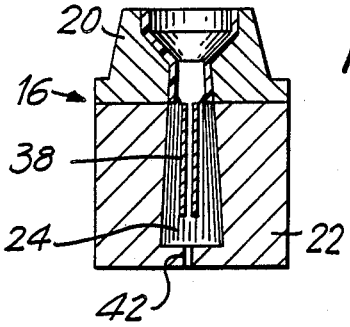
FIG. 9
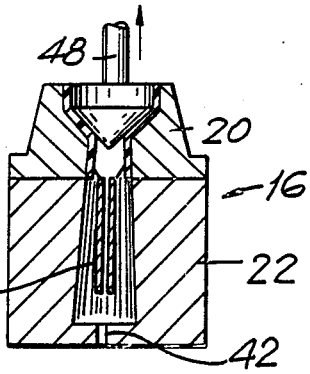
FIG.10
FIG. 11
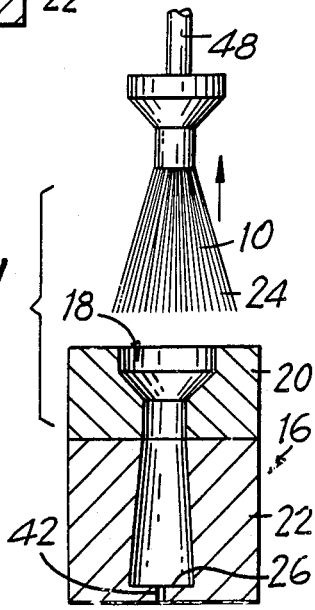

METHOD OF FORMING A BRUSH

FIELD OF THE INVENTION

The present invention relates to brush fabrication methods and, more particularly, to improvements in the forming of brushes which include a peipherally-interior, substantially flexible, tubular distribution channel for feeding fluid from the brush head toward and to the distal ends of the brush for selective application of the fluid to a workpiece.

BACKGROUND OF THE INVENTION

There exist in the art numerous forms and methods of fabricating brushes intended for use in applying a flowable fluid, typically liquid, to a workpiece. Among such brushes is that, and the method of making the article, disclosed in U.S. application Ser. No. 222,808 filed July 22, 1988 to McNab. The McNab brush is formed of a plurality of bristles or filaments that are assembled into a tuft and are secured together at one end to define the head or head section of the brush. A particularly advantageous feature of the McNab brush is the further provision of a substantially flexible, relatively thin-walled distribution channel that axially extends through a peripherally-interior portion of the tuft from the head section toward the distal ends of the filaments. This distribution channel provides an internal, substantially flexible passageway for feeding flowable fluid from the head section of the brush to the filaments proximate their distal ends for selective application of the fluid to a workpiece. An alternate method of making the McNab brush is disclosed in U.S. application Ser. No. 400,983, filed Aug. 31, 1989, of Kay.

As described in each of these earlier disclosures, the distribution channel of the brush is fabricated by fusing or melting of the heat-fusible synthetic material of the filaments. Accordingly, in order to achieve the desired relatively thin-walled construction and substantial flexibility of the distribution channel sidewall, the material fusing time and temperature must be carefully controlled. Furthermore, the production volume of brushes that may be commercially manufactured in a given time period may be limited by, for example, the heating and cooling requirements of the fabrication process. Finally, the need to form the distribution channel through heat fusing of the filaments material limits the selection of materials from which such brushes are formable.

OBJECTS OF THE INVENTION

It is the desideratum of the present invention to provide a method of fabricating a brush incorporating a substantially flexible, peripherally-interior fluid distribution channel that overcomes some or all of the disadvantages of prior art methods.

It is a particular object of the invention to provide such a method that assures the formation of distribution channels having a relatively thin-walled sidewall of consistent thickness from brush-to-brush.

It is another object of the invention to provide such a method that may be practiced using a wide range of materials including, for example, natural hair bristles.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

FIGS. 3 to 11 serially depict the various steps in the herein described, preferred method of fabricating a brush in accordance with the present invention.

DETAILED DESCRIPTION OF THE PREFERRED EMBODIMENTS

Figure 1:
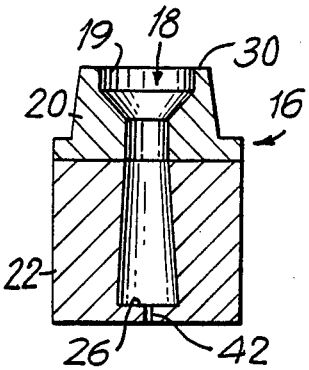
FIG. 1 is a side view, in cross section, of a mold for use, by way of example, in the fabrication of a brush in accordance with an embodiment of the invention.

The present invention is directed to a method of fabricating a brush of particular utility for applying a pumpable or otherwise flowable fluid—such, as is generally but not exclusively contemplated, as a liquid—to a workpiece. The brush that results from the practice of the inventive method is substantially of the type which is illustrated and described in allowed and commonly-owned U.S. patent application Ser. No. 222,808 filed July 22, 1988, the entire disclosure of which is incorporated by reference herein. Thus, the brush is formed of a plurality of elongated bristles or filaments that are assembled into a tuft and are secured together at one (i.e. proximal) end to define a head or head section of the brush, the opposite (i.e. distal) ends of the bristles remaining freely and flexibly movable relative to each other for applying a liquid or flowable fluid to a workpiece. Most importantly, the brush also includes a relatively thin-walled, substantially flexible, elongated distribution channel which extends axially through a peripherally-interior portion of the tuft from or proximate the head section toward the distal ends of the filaments. The distribution channel is defined by an annular membrane or wall bounding an internal passageway for feeding flowable fluid from the head section of the brush to the filaments proximate their distal ends for selective application of the fluid to a workpiece. The brush is accordingly of particular utility for mounting or attachment to the discharge end of a fluid dispenser or the like so that fluid operatively discharged from the dispenser enters the brush head and is disseminated by the distribution channel to the distal ends of the brush bristles. The substantial flexibility of the distribution channel is especially advantageous in preventing inadvertent damage to the workpiece, as for example scratching or chaffing of the skin of a user when the fluid is a cosmetic liquid applyable to the skin, should the brush be pressed with undue force against the surface to which an application of fluid is intended.

In a particularly preferred form of the inventive method, the brush is fabricated in its entirety of one or more heat-fusible synthetic materials; for this purpose, thermoplastic materials having known or readily determinable melting points or ranges, such as nylon, may be employed. Nevertheless, as is hereinafter discussed the brush may alternatively be formed all or in part of natural hair or fibers, and such modifications should be clearly understood as being fully within the intended scope of the invention. Indeed, the use of still other construction materials, although not expressly described or enumerated herein, is also contemplated.

The essential feature of the herein-disclosed method of the invention is that the substantially flexible distribution channel is preformed or fabricated—generally as a sleeve-like tubular member—separate and apart from the assembled tuft-delineating bristles and is subsequently inserted into the interior of the tuft. The preformed distribution channel is then secured to at least the immediately adjacent bristles along, preferably, substantially the full length of the channel wall so as to nonremovably affix the channel to the bristles and positionally within the brush. The manner in which the bristles are secured together at their proximal ends to form the brush head or head section—and the sequence or timing of such securement, relative to the insertion and securement of the preformed distribution channel and its securement to the immediately adjacent bristles—is substantially a matter of design choice and may be carried out in any convenient, suitable and/or effective way in accordance with the particular material of which the filaments are formed and the ultimate intended use of the resulting brush. Similarly, the form or shape or configuration of the resulting brush head is also substantially a matter of design choice although, of course, it is intended that the head or head section of any brush formed in accordance with the method of the invention include an opening or throughbore or passageway for enabling fluid that is to be applied to a workpiece by the brush to feed from the brush head, to and through the distribution channel and onto the distal ends of the filaments. In any event, for purposes of illustration, ease of description and as a currently preferred embodiment of the invention, the brush, and its fabrication, are described herein as having a head section formed in general accordance with the structure and method steps set forth in allowed and commonly-owned U.S. patent application Ser. No. 400,983 filed Aug. 31, 1989, the entire disclosure of which is also incorporated by reference herein. It should, however, be understood and appreciated that the present disclosure is, with respect to the head section, by way of example only and that numerous other head-forming methods, techniques and arrangements—only some of which are expressly mentioned herein—are also contemplated. Thus, the precise form and construction of the brush head or head section, and the manner in which the same is fabricated in accordance with this description, is not intended and should not be understood as a limitation on the scope of the invention to which this disclosure is directed.

The currently preferred method of the invention will now be described with specific reference to the drawings. In this particular preferred but nonetheless illustrative embodiment, the brush is fabricated, in part, of a plurality of elongated bristles or filaments or fibers 10 formed of a heat-fusible synthetic material as, for example, a polymer such as nylon or polyethylene or the like. The elongated filaments are initially assembled into a tuft thereof and are then placed into a holder in which the filaments are retained during substantially the remainder of the brush-fabricating process. Typically, as is known in the art, a multiplicity of such filaments are arranged in parallel relationship in a puck or other supply container or process from which a desired quantity and/or density of filaments is picked to form a tuft of a desired cross-sectional shape. Thus, in accordance with the method of the invention, and by way of example, a pick-up tube 12 (FIG. 3) is inserted into a puck (not shown) or the like containing a multiplicity of parallel synthetic filaments and, when the pick-up tube 12 is subsequently withdrawn from the puck, it contains a plurality of the elongated filaments which collectively define the filament tuft or bundle 14. The filaments contained in the puck and picked up by reciprocated insertion and withdrawal of the pick-up tube 12 may be cut-to-length before picking, as is preferred, or may be cut down to appropriate length(s) subsequent to the fiber picking operation. Although it is generally intended that all of the plural filaments 10 forming the tuft 14 be, at least at the outset, of substantially the same length, embodiments in which filaments of different lengths are contained in the tuft 14 as of or immediately after the picking or optional filament-trimming or shaping operations are also contemplated.

Figure 2:
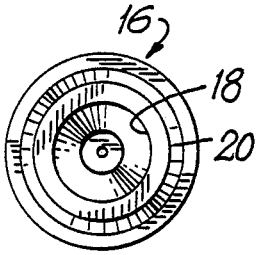
FIG. 2 is a top plan view of the mold of FIG. 1.

A suitable holder into which the tuft 14 of filaments may be received for further processing in the fabrication of the brush is illustrated, by way of example, in FIGS. 1 and 2. This tuft holder or mold 16 includes a cavity 18 extending into the interior of the mold for receiving and retaining the tuft of filaments during the brush-fabricating process. As should be apparent to those skilled in the art, cavity 18 may be specially configured in accordance with the intended final configuration of the brush.

Thus, in the presently disclosed embodiment of the invention the mold 16 comprises an upper mold head or die 20 formed of a material that may, if desired, be at least somewhat conductive and retentive of heat and which is disposed at that portion of the mold which includes the open end 19 of the tuft-receiving cavity 18. The uppermost section of the mold head 20 has a generally frustoconical outer periphery. The radially-interior wall of the head 20 that peripherally bounds the cavity 18 operatively defines, in use, the final configuration of the head section of the brush as will hereinafter become apparent. The remainder or relatively lower-disposed (in FIG. 1) base section 22 of the mold 16—i.e. that portion peripherally bounding the relatively freely-movable fibers in the completed brush—is preferably formed of a material that neither readily retains nor absorbs heat. Presently contemplated materials for this base section 22 of the mold are, by way of example, polished stainless stell and asbestos.

Figure 3:
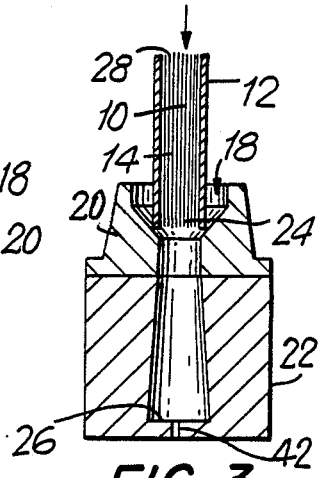

After having been picked from the puck or other supply of filaments by tube 12, the resulting tuft 14 is inserted into the mold cavity 18 through the cavity open end 19 (FIG. 3). The transfer of the tuft from the pick-up tube 12 to a receiver—such as the mold 16—may be effected in any conventional or otherwise appropriate manner such, for example, as by driving the tuft from the tube through operation of a reciprocatable piston.

Thus, pick-up tube 12 is moved into suitable abutment or proximity with mold head 20 and the tuft 14 of filaments is driven into the cavity 18 until the distal ends 24 of the filaments and tuft substantially abut the cavity bottom 26. The pick-up tube is then retracted (FIG. 4) from the mold. As is illustrated in FIGS. 4 to 6, in the particular form of the brush head resulting from the practice of that embodiment of the inventive method herein described, the cut-to-length elongated filaments 10 are preferably sized so that they initially protrude, at their distal ends 28, beyond the top face or surface 30 of the mold at the cavity open end 19 by an amount selected to provide a sufficient volume of the synthetic material of the filaments for forming the peripheral wall of the completed brush head.

A heater or die block 32, at an elevated temperature sufficient to effect preferably rapid fusing of the synthetic material of the filaments, is subsequently moved into heat transfer relation with the proximal ends 28 of the filaments 10 so as to melt or fuse the filament ends and form the head section of the brush in that portion of the cavity 18 defined within the mold head 20. Where the synthetic material of the filaments is, for example, nylon, the block 32 may be heated to a temperature of approximately 550° to 600° F. which is suitably at or above the melt point or range of the material. As seen in FIGS. 5 to 7, the die 32 has a recess 34 that is generally frustoconically-configured in accordance with the the outer periphery of the mold head 20. Moreover, the recess 34 is sized so that when the die 32 is lowered about the mold head 20 as seen in FIG. 7, the interior radial wall of the die recess is disposed in closely proximate but spaced apart relation with the outer radial periphery of the mold head. Thus, the heated die 32 and the mold head 20 are, as is currently preferred, not brought into direct heat-transfer contact or abutment. In this manner, the transfer of filament fusing heat from the heated die 32 to the filament proximal ends 28 takes place—at least primarily—by convection or, put another way, through the transmission of heat from the heated die 32 to the filament proximal ends across the space defined between the heated die and the open end 19 of the mold body cavity 18. Inasmuch as this manner of fusing the filament proximal ends—as contrasted with bringing the heated die 32 into direct contact or abutment with the mold head 20 (so as to heat the head 20 and thereby effect fusing of the filament ends)—has been found to yield an enhanced brush head section, this relative movement of the die 32 and mold head 20 into closely proximate but spaced apart relation is, at present, most preferred for forming a brush head section of the particular type illustrated and described, by way of example, herein.

Figure 5:
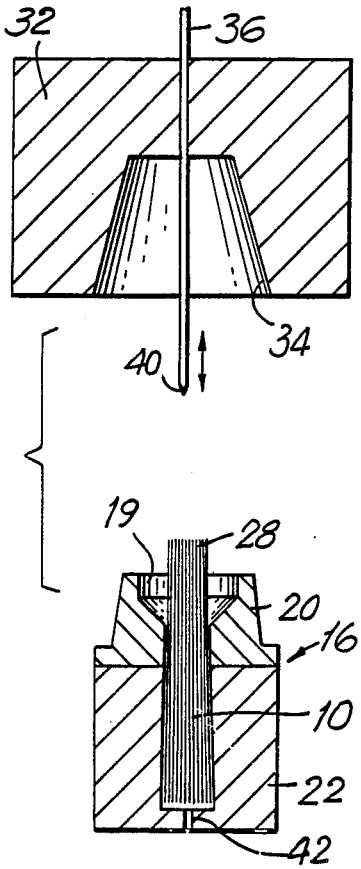
Figure 6:
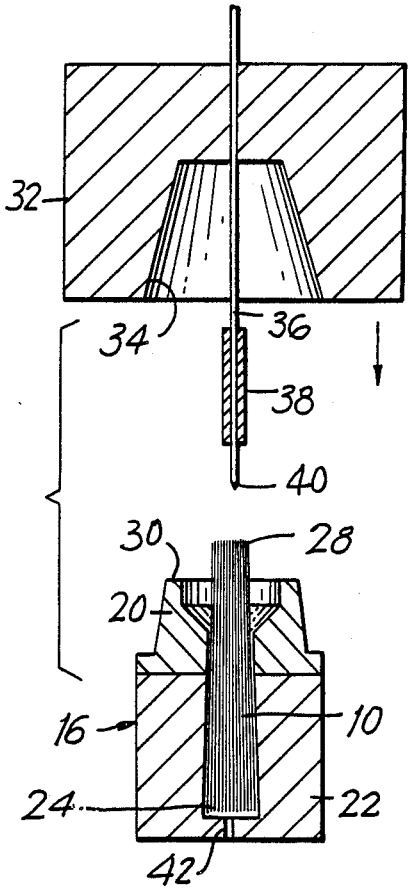

With reference now to FIG. 5, the heater die 32 further includes an axially-defined opening or passageway through which a relatively small-diameter elongated rod or pin 36 is journalled for longitudinal and reciprocatable movability relative to the die 32. The pin 36 is controllably heatable, separate and apart from the heating of the die 32, by any suitable means or apparatus. The passageway through the die 32 and along which the pin 36 is slidably movable, and/or the pin 36, accordingly may be insulated or otherwise sized or fabricated or coated so as to at least minimize the transfer of heat between the heated die 32 and the pin 36. Thus, it is generally intended that heating of the die 32 will not directly result in substantial heating of the pin 36. Nevertheless, embodiments of the invention in which a predetermined heat transfer from the heated die 32 to the pin 36 is not only desired, but intended, are also contemplated.

With the pin 36 extending through the recess 34 and beyond the lowermost edge or boundary of the die 32—and prior to the lowering of the heated die 32 into closely proximate but spaced apart relation with the mold head 20—a preformed, elongated sleeve-like tube 38 is slid onto or otherwise disposed at a predetermined position on or along the tube between the die 32 and mold head 20. The bore or passageway defined through the tube 38 is preferably sized and shaped so as to define a relatively snug fit of the tube over the pin 36 and thereby prevent unintended relative sliding movement of the tube longitudinally along the pin from the predetermined position at which the tube is initially disposed. The tube 38 is further defined by a continuous, relatively thin sidewall and is preferably formed of a substantially flexible material such, for example, as a fusible thermoplastic. Preferably, the tube sidewall has a thickness in the range of approximate one to three times the diameter of the filaments 10, although the use of even greater relative wall thicknesses of the tube sidewall is also contemplated for particular applications.

The tube material may be the same material as that from which the fibers or filaments 10 are formed, or a different material such, by way of example, as the currently preferred Kevlar. Indeed, the tube 38 may as a matter of design choice be formed of almost any material, synthetic or natural, capable of providing a substantially flexible, thin-walled tube, so long as the immediately-adjacent filament material is readily securable to the outer periphery of the tube in accordance with the invention. Where a material different than that of the filaments is selected, the material of the tube 38 will, as will hereinafter be apparent, preferably have a melting or fusing point or temperature range at least as great as the fusing point or range of the filaments material and, even more preferably, greater than the fusing point or range of the filaments material. Kevlar, the preferred material for the tube 38, for example, has a melting point of approximately 900° F. and may therefore be used in conjunction with filaments of nylon, which fuses at approximately 550° F. The length of the tube 38 is selected, as will also become apparent, in accordance with the desired length of the fluid distribution tube that will, in the completed brush, extend axially through and along the tuft interior for conducting fluid from the brush head to or proximate the filament distal ends. Obviously, the tube cannot have a length longer—and in most cases not even as long as—the initial length of the filaments 10 at the time of their insertion into the mold 16.

It is generally contemplated that the sleeve-like tube 38, and its interior bore or passageway, have a substantially circular cross-sectional shape and, correspondingly, that the pin 36 also have a conformingly circular cross-section. Nonetheless, other cross-sectional configurations of the tube 38, and/or of its interior bore, may be employed in accordance with those details or elements of the intended or desired final brush design. Whatever these cross-sectional configurations, however, in order to facilitate suitable heat transfer from the heated pin 36 to the outer periphery of the tube 38 during formation of the brush—as hereinafter described—it is greatly preferred, and generally intended, that the cross-sectional shape of the pin 36 —at least at that portion of the pin on which the tube is supportedly journalled—relatively closely conform to the cross-sectional shape of the tube bore.

With the tube 38 disposed about a predetermined longitudinal portion of the pin 36, the heater block or die 32—preferably already at or near the elevated temperature at which fusing of the filament proximal ends 28 to form the brush head section will take place—is lowered from its FIG. 6 to its FIG. 7 position. As previously noted, in its FIG. 7 position the die 32 is most preferably disposed in closely proximate but spaced apart relation to the confronting peripheral wall portions of the mold head 20 so as to minimize or avoid substantial heating of the mold head. At the same time or, alternatively, selectively prior to this lowering of the heated die 32 into heat transfer relation with the filament proximal ends 28, the pin 36 descends so that its tip 40 moves into and through the interior of the tuft 14 and thereby carries the tube 38 predeterminately into the tuft interior. The pin tip 40 may be pointed or tapered so as to facilitate its entry into and through the radial interior of the tuft. In longitudinally positioning the tube 38 within the filaments tuft 14 it is preferred—particularly where a molded head section such as that herein described by way of example is being formed on the brush—that the top of the tube 38 be located substantially coincident with or closely proximate the lower end of the brush head section being or to be formed. When the tube 38 reaches its intended position within the filaments tuft, further descending movement of the pin 36 ceases and the pin is held stationary so as to correspondingly maintain the predetermined position of the sleeve-like tube relative to the radially surrounding filaments 10. Unintended lateral movement of the pin 36 may be prevented by so placing the tube 38 longitudinally along the pin that, with the tube at its predetermined securement position within the tuft, the pin end 40 extends into or at least partly through a bore 42 defined at the bottom of the mold base 22.

Because it is generally contemplated that the die 32, as the same is lowered to its FIG. 7 position, is already at or near or approaching an elevated temperature sufficient to fuse the material of the filaments and thereby form the brush head, movement of the heated die into heat transfer relation with the filament ends 28 effects sufficient heating of the confined space in the recess 34 between the lowered die 32 and the mold head 20 to cause melting of the filaments proximate their ends. The heated die is maintained in its FIG. 7 position for a cycle time or period selected so that, when the die is subsequently retracted (as indicated by the arrow 44 in FIG. 7), the synthetic material within the mold head 20 has fused and formed, along the interior peripheral wall sections of the mold, the brush head section wall. The lower portions of the filaments 10 in the tuft 14, on the other hand, by reason of their containment within that portion of the mold cavity 18 bounded by the base 22, remain unfused and thus retain their original elongated filamentary form. These unfused and relatively movable fibers are, nonetheless, unitarily connected at and to and depend from the fused synthetic material within the mold head 20, which fused material defines the head section of the brush and has been formed from the original proximal ends of the filaments. The heated die 32 may, optionally, be cooled or permitted to cool to a temperature less than the fusing temperature or range of the filaments material prior to its retraction from the FIG. 7 position.

After the brush head has been so formed by fusing of the filament proximal ends 28 and the heated die 32 has been withdrawn, the sleeve-like tube 38 is secured to the immediately adjacent filaments 10 in the tuft 14. It should first be noted that, depending on the predetermined location at which the tube 38 is supported within the tuft by the pin 36, the formation of the brush head section by fusing of the filament proximal ends may have already at least partially secured the tube 38 in place through fusing of some of the synthetic material of the filament proximal ends to the upper (in the Figures) portion of the tube. Nevertheless, any such partial securement that may have thereby occurred is not, in accordance with the present invention, intended to constitute or be depended upon as the sole means of positionally fixing the tube 38 within the completed brush and, in particular, substantially centrally within or otherwise inwardly of the radially-outward periphery of the brush.

Securement of the tube 38 to the immediately adjacent filaments in the tuft 14 is effected by heating of the pin 36 to a temperature sufficient to fuse the immediately adjacent filaments 10 to the outer periphery of the tube 38 along, most preferably, substantially the full length of the tube. At the same time, however, it is important—indeed, it is a fundamental aspect of the presently-disclosed method—that the heating of the pin, and the heat correspondingly transferred to and through the tube 38 to the adjacent filaments 10, causes the fusing of only or primarily those filaments immediately or substantially immediately adjacent the tube periphery and not, in addition, substantial numbers of filaments 10 disposed radially outwardly from the immediately-adjacent filaments. Those skilled in the art will appreciate that unless the filaments thereby fused to the tube periphery are generally limited to those immediately or substantially immediately adjacent the tube, the significant advantages attained through the inclusion of a thin-walled, relatively flexible fluid distribution channel extending axially along and within the radial interior of the brush will be lost. Indeed, in extreme cases of undesired radially-outward heating the distal end of the resulting article would resemble not so much the fluid-applying end of a brush but, rather, a general inflexible, solidly fused bar or mass of synthetic material; such a structure is quite clearly not intended.

It is accordingly important that the temperature to which the pin 36 is heated, and the period of such heating, be carefully controlled. Of course, the specific temperature and cycle time of such heating will depend on a number of factors—including, by way of example, the size of the brush being formed, the material of the filaments 10, the material of the tube 38, the thickness of the tube wall, and the diameter of the filaments —and must therefore be determined by the practitioner of the method of the present invention. For example, using nylon filaments and a Kevlar tube having a wall thickness of approximately 3 to 6 mils, a pin temperature of approximately 550° F.—corresponding to the low end of the melt range of nylon—would be employed. In any event, the determination of appropriate pin temperature and heating time is considered to be well within the ability of the person of ordinary skill and does not, given knowledge of the instant disclosure, require undue experimentation.

Heating of the pin 36 can be carried out in any suitable manner as a matter of design choice and convenience. For example, a portion or end (not shown) of the pin remote from its tip 40 may be heated, as by heat-transfer contact with a heated member, and the pin formed of a material that readily transfers such heat along its length to and, if desired, including its tip 40. Alternatively, with the pin constructed of an electrically conductive material that heats when an electric current flows therethrough, the opposite ends or other spaced apart portions of the pin may be selectively connected between a controllable electric potential to effect such a current flow and thereby cause heating of the pin. These and numerous other pinheating arrangements are within the scope and contemplation of the invention. Similarly, the precise manner of controlling the heating or cycle time of the pin 38 should also be considered a matter of design choice. For example, the pin may be formed of a material that relatively or sufficiently rapidly cools when the source of such heating is removed or discontinued, or a coolant may be circulated through the pin interior, or the pin may simply be withdrawn (as indicated by the arrow 46 in FIG. 8) while still in an elevated temperature condition from within the tube 38 and tuft 14 when fusing of the immediately adjacent filaments to the tube has been accomplished. Here, again, these and other appropriate arrangements for discontinuing the heat-induced fusing of the immediately adjacent filaments are contemplated as a matter of design choice.

Thus, in accordance with the inventive method the pin 36 is heated (FIG. 8) to a predetermined temperature sufficient to fuse the immediately adjacent filaments 10 to the outer periphery of the sleeve-like tube 38. The heat from the pin is transferred through the thin-walled tube 3 to the adjacent filaments, thereby unitarily fusing the tube wall and adjacent filaments along substantially the full length of the tube and non-removably fixing the tube longitudinally and laterally within the filament tuft 14. Where, as is preferred, the tube is formed of a material having a melt point or range higher than the melt point or range of the filaments material, the predetermined temperature to which the pin 36 is heated is preferably at least as high as the melt range of the filaments but no higher than the melt range of the tube. This limitation assures that the tube 38 substantially retains its preformed shape while adequately securing the immediately adjacent filaments to the tube periphery. It should nevertheless be understood that, particularly where the respective melt temperatures or ranges of the filaments and tube materials are relatively close, pin temperatures at least as high as the melt range of the tube may be employed where, for example, some melt-induced reforming of the tube 38 is desired. Where, on the other hand, the filaments and tube are formed of the same synthetic material, it is generally contemplated that the predetermined temperature be no higher than approximately the low end of the temperature range at which the synthetic material fuses so as to avoid inordinate or otherwise unintended deformation of or changes to the preformed construction of the sleeve-like tube 38.

The intention, therefore—whatever the respective materials of the filaments and tube—is to apply to the immediately adjacent filaments through the heated pin and tube wall at least, and preferably no more than, just enough heat to fuse those immediately adjacent filaments to the tube periphery without either unintendedly deforming the preformed tube 38 or additionally fusing to the tube periphery appreciable numbers of the filaments disposed radially-outwardly from those located immediately or substantially immediately adjacent the tube.

It should also be noted that although the steps of forming the brush head section (through heat transfer from the heated die 32) and of affixing or securing the tube 38 and the immediately adjacent filaments (through heating of the pin 36) have been described as taking place in a serial or generally consecutive fashion, they may instead be carried out substantially concurrently or, indeed, in the reverse order or sequence as a matter of design choice. Indeed, it is also contemplated that the insertion of the tube 38 into the interior of the tuft take place, alternatively, subsequent to formation of the brush head section. These and numerous other variations in the method steps and sequences herein illustrated and described should be understood as being within the intended scope and contemplation of the invention.

When, as a result of the pin-heating step of the inventive method, the immediately adjacent filaments 10 have been fused to the periphery of the tube, the pin 36 is withdrawn (FIG. 8) from within the tube 38 and the tuft 14 which now carries, at its proximal end, the molded brush head. By virtue of the tube having been integrally secured to the immediately adjacent filaments 10 and, preferably, the lower portion of the molded head section, the tube 38 remains within the tuft interior as the pin is withdrawn and now defines the fluid distribution channel of the brush (FIG. 9). Thus, fluid entering the brush head section—as for example from the discharge outlet of a fluid dispenser on which the brush may, in use, be mounted or otherwise supportedly depend—flows through the brush head and into and along the fluid distribution channel to or proximate the freely-movable distal ends of the filaments for selective application to a workpiece.

The withdrawal of the pin 36 from the sleeve-like tube 38 may be accomplished or facilitated in any number of ways, generally as a matter of design choice and, in some instances, dependent on the particular material(s) from which the tube 38 and/or the filaments 10 have been formed. In some instances the pin may be withdrawn while it remains at or relatively close to the elevated temperature to which it has been heated for fusing the immediately adjacent filaments to the tube periphery. In other cases it may be necessary or helpful to substantially cool or reduce the pin temperature prior to its withdrawal. Such withdrawal may also be facilitated by axially rotating the pin 36 or by applying acoustic energy to the pin so as to free it from within the tube bore should the tube material stick to the pin. The outer periphery of the pin 36 may also, to avoid such sticking, be coated with or otherwise formed of a material expressly selected for that purpose.

With the pin 36 thus suitably withdrawn from proximity with the mold 16 (FIG. 9), fabrication of the brush is substantially complete. The completed brush may be removed from the mold cavity in any convenient manner, an example of which is depicted in FIGS. 10 and 11. As there shown, a rubber or similarly flexibly resilient pick-up member 48 is moved into the interior of the brush head section to form an interference or press fit with the interior of its head section-defining peripheral wall. When the member 48 is thereafter retracted from the mold (FIG. 11), it carries with it the integral brush which may then, for example, be mounted to a fluid dispenser or the like and/or, if desired, subjected to buffing or other finishing steps which form no part of the present invention.

The method of the invention, therefore, broadly comprises a novel series of steps that may be expressed as follows. A plurality of filaments are formed into a tuft. The proximal ends of the filaments in the tuft are secured together to define the head or head section of the brush. An elongated, substantially flexible tube having a bore or passageway that extends longitudinally through the tube is inserted into a peripherally-interior portion of the tuft so that the passageway extends along the tuft from the brush head toward the distal ends of the filaments. And the filaments which lie immediately adjacent the tube are secured to the tube periphery along substantially the full length of the tube so as to positionally fix the tube within the filaments tuft and thereby define an integral and substantially flexible fluid distribution channel in the brush for feeding a flowable fluid through the brush from the brush head to the filaments proximate their distal ends for selective application of the fluid to a workpiece.

These method steps have been hereinabove-described in the context of a particular, currently preferred (but nonetheless illustrative) embodiment of the invention. In that embodiment, the filaments are formed of a heat-fusible synthetic material, the filament proximal ends are secured together to define the brush head by applying heat to the filaments to melt their ends and thereby fabricate a molded head section having a particular configuration, and the immediately adjacent filaments are secured to the outer periphery of the tube by heat-induced fusing of those adjacent filaments to the tube wall. Those skilled in the art will, however, recognize and appreciate that numerous modifications of the hereinabove-described method of practicing the invention are contemplated. For example, it is intended that the brush may alternatively be formed of filaments of natural hair instead of a synthetic heat-fusible material. As an illustration of the variations required to adapt the inventive method to different brush forms, the differences between the method steps already described and those involved in fabricating a natural hair brush will now be described.

The primary differences in forming a natural hair brush concern the specific ways in which, first, the proximal ends of the filaments are secured together to define the brush head and, second, the immediately adjacent filaments are secured to the outer periphery of the tube so positionally fix the tube within the tuft. The former may be carried out in any manner, as a matter of design choice, heretofore conventionally known or otherwise suitable for securing together a tuft of natural hair bristles or filaments. Solely by way of example, the filament proximal ends may be adhesively glued or joined, may be tightly crimped within a circumferentially-enveloping band, or may be frictionally held within a cup-like element disposed about the filament ends and incorporating at least a bore or opening for permitting the entry of fluid into the interior of the tuft for feeding or distribution, through the distribution channel of the brush, to the filament distal ends. As previously noted, however, the precise manner in which the filaments—formed of whatever material—are secured together at their proximal ends is a matter of design choice and not an essential feature of the invention.

Insofar as the securement of the immediately adjacent natural hair filaments to the outer periphery of the sleeve-like, distribution channel-defining tube, in a preferred arrangement a suitable adhesive is deposited on and along the outer periphery of the tube prior to its insertion into the predetermined peripherally-interior portion of the tuft. In a particularly preferred form, the adhesive is of the type that is activated—i.e. that exhibits its adhesive properties—when heated. Thus, the adhesive is deposited or applied to the outer periphery of the tube and is permitted to dry or cure or otherwise reach a state in which it is not sticky or, in other words, it will not stick to the immediately adjacent filaments as the tube is inserted into the tuft interior. The tube is then heated, as by heating of a rod or pin supportedly journalled through the pin as hereinabove-described and illustrated in FIG. 8, causing the activation of the adhesive. The immediately or substantially immediately adjacent natural hair filaments thereby adhere to the outer periphery of the tube and, as the adhesive dries or cures, become nonremovably secured thereto. In this manner, the tube—which may be formed of any suitable material to which the selected adhesive will adhere and that is compatible with the fluid to be used with the brush—is positionally fixed within and to the filaments and, correspondingly, the resulting brush.

Other adhesives, such as those which cure or exhibit their adhesive properties when exposed to ultraviolet radiation or to light, may also be employed in accordance with the invention.

Another example of a currently contemplated alternative embodiment is the substantially concurrent formation of the brush head and the securement of the preformed sleeve to the immediately-adjacent filaments in the tuft. Such a one-step brush forming process—as contrasted with the substantial twostep methods expressly described hereinabove—may be applied whether the brush is fabricated of a heat-fusible synthetic material or of natural hair filaments.

Numerous additional modifications to the several above-described embodiments of a method of forming a brush for applying a flowable fluid to a workpiece are intended and will be apparent from the foregoing disclosure. It will therefore be appreciated that the inventive method that is the subject of this disclosure is substantially broader than the several exemplary embodiments expressly described herein. Thus, while there have been shown and described and pointed out fundamental novel features of the invention as applied to preferred embodiments thereof, it will be understood that various omissions and substitutions and changes in the form and details of the disclosed methods may be made by those skilled in the art without departing from the spirit of the invention. It is the intention, therefore, to be limited only as indicated by the scope of the claims appended hereto.

What is claimed is:

1. A method of forming a brush for applying a flowable fluid to a workpiece, comprising the steps of:

assembling a plurality of elongated filaments into a tuft of said filaments;

securing together the proximal ends of the filaments in said tuft so as to define a brush head at the proximal end of the tuft;

inserting an elongated, substantially flexible tube having a passageway extending longitudinally therethrough into a peripherally-interior portion of said tuft so that said passageway extends along the tuft from said brush head toward the distal ends of the filaments; and securing the filaments which lie immediately adjacent said tube to the tube along substantially the full length of said tube so as to positionally fix said tube within said filaments tuft and define with said tube an integral and substantially flexible fluid distribution channel in said brush for feeding a flowable fluid through said brush from the brush head to the filaments proximate the filament distal ends for selective application of the fluid to a workpiece.

2. A method in accordance with claim 1, wherein said filaments are formed of a heat-fusible synthetic material.

3. A method in accordance with claim 2, wherein said step of securing the immediately adjacent filaments to said tube comprises fusing the filaments which lie immediately adjacent said tube to the tube.

4. A method in accordance with claim 2, wherein said step of securing the immediately adjacent filaments to said tube comprises fusing the filaments which lie immediately adjacent said tube to the tube by heating the immediately adjacent filaments so as to melt said immediately adjacent filaments to said tube.

5. A method in accordance with claim 2, wherein said heat-fusible synthetic material has a first fusing temperature and said tube is formed of a material having a second fusing temperature higher than said first temperature.

6. A method in accordance with claim 2, wherein said step of securing the immediately adjacent filaments to said tube comprises inserting a heatable member into said tube passageway and heating said heatable member so as to heat said tube to a temperature sufficient to fuse the filaments which lie immediately adjacent said tube to the tube.

7. A method in accordance with claim 2, wherein said step of securing the immediately adjacent filaments to said tube comprises inserting a heated member into said tube so as to heat said tube to a temperature sufficient to fuse the filaments which lie immediately adjacent said tube to the tube.

8. A method in accordance with claim 7, wherein said heat-fusible synthetic material has a first fusing temperature and said tube is formed of a material having a second fusing temperature higher than said first temperature.

9. A method in accordance with claim 2, wherein said step of securing the immediately adjacent filaments to said tube comprises heating the tube to at least a predetermined temperature.

10. A method in accordance with claim 9, wherein said heat-fusible synthetic material has a first fusing temperature and said predetermined temperature is at least as high as said first fusing temperature so as to heat-fuse the immediately adjacent filaments to the tube.

11. A method in accordance with claim 10, wherein said tube is formed of a material having a second fusing temperature higher than said first fusing temperature.

12. A method in accordance with claim 2, wherein said step of securing together the filament proximal ends comprises heating the proximal ends of the filaments in said tuft so as to form the brush head.

13. A method in accordance with claim 2, wherein said securing together of the filament proximal ends comprises heating the proximal ends of the filaments in said tuft so as to fuse together said filament proximal ends and form the brush head.

14. A method in accordance with claim 2, wherein said tube is formed of the same material as said filaments.

15. A method in accordance with claim 2, wherein said tube is formed of a heat-fusible synthetic material.

16. A method in accordance with claim 2, wherein said filaments are formed of nylon and said tube is formed of Kevlar.

17. A method in accordance with claim 1, wherein said step of securing the immediately adjacent filaments to said tube comprises heating the tube to at least a predetermined temperature.

18. A method in accordance with claim 1, wherein each of the filaments has a length, and said tube has a length less than the lengths of all said filaments.

19. A method in accordance with claim 1, wherein the plural filaments have a substantially uniform length, and said tube has a length less than said substantially uniform length of the filaments.

20. A method in accordance with claim 1, wherein said tube has a length selected so that, when the tube is inserted into said tuft and secured to the immediately adjacent filaments, the end of said tube closest to the filament distal ends is inwardly spaced from the filament distal ends in the direction of the brush head.

21. A method in accordance with claim 1, wherein said step of securing together the filament proximal ends comprises heating the proximal ends of the filaments in said tuft so as to form the brush head.

22. A method in accordance with claim 1, wherein said filaments are formed of natural hair.

23. A method in accordance with claim 1, wherein the tube has a peripherally outer face, said method further comprising depositing on the outer tube face an adhesive material for use in securing the immediately adjacent filaments to said tube.

24. A method in accordance with claim 23, wherein said step of securing the immediately adjacent filaments to the tube comprises heating the adhesive material on said outer tube face to a temperature sufficient to cause the adhesive material to adhere the immediately adjacent filaments to the tube.

25. A method in accordance with claim 24, wherein said step of heating the adhesive material comprises heating the tube.

26. A method in accordance with claim 25, wherein said adhesive material comprises a heat-activated adhesive material, and said step of securing the immediately adjacent filaments to the tube comprises inserting a heatable member into said tube passageway and heating said heatable member so as to heat said tube to a temperature sufficient to activate the adhesive material and thereby cause the adhesive material to adhere the immediately adjacent filaments to the tube.

27. A method in accordance with claim 23, wherein said adhesive material comprises a heat-activatable adhesive material, and said step of securing the immediately adjacent filaments to the tube comprises inserting a heated member into said tube passageway so as to heat the tube to a temperature sufficient to activate the adhesive material and thereby cause the adhesive material to adhere the immediately adjacent filaments to the tube.

28. A method in accordance with claim 1, wherein said tube is formed of Kevlar.

29. A method in accordance with claim 1, wherein said tube comprises a thin-walled tube having a wall thickness in the range of 3 to 6 mils.

30. A method in accordance with claim 29, wherein said tube is formed of Kevlar.

31. A method in accordance with claim 29, wherein said tube is formed of a heat-fusible synthetic material.

32. A method in accordance with claim 1, wherein said tube and said filaments are formed of the same material.

33. A method in accordance with claim 1, wherein said step of inserting the elongated, substantially flexible tube into a peripherally-interior portion of the tuft comprises moving the tube into the peripherally-interior portion of the tuft along a path defined substantially parallel to the elongation of the filaments forming said tuft.

34. A method in accordance with claim 1, wherein said tube is formed of a heat-fusible synthetic material.

35. A method in accordance with claim 1, wherein each of said filaments has a diameter, and said flexible tube comprises a wall that bounds said passageway and has a thickness in the range of approximately two to three times said filaments diameter.

* * * * *